US008357865B2

(12) United States Patent
Ng et al.

(10) Patent No.: US 8,357,865 B2
(45) Date of Patent: Jan. 22, 2013

(54) KEYPAD ILLUMINATION APPARATUS

(75) Inventors: Fook Chuin Ng, Penang (MY); Choon Guan Ko, Penang (MY); Felix Cheang, Panang (MY); Boon Keat Tan, Singapore (SG)

(73) Assignee: Avago Technologies ECBU IP (Singapore) Pte, Ltd., Singapore (SG)

( * ) Notice: Subject to any disclaimer, the term of this patent is extended or adjusted under 35 U.S.C. 154(b) by 582 days.

(21) Appl. No.: 12/571,763

(22) Filed: Oct. 1, 2009

(65) Prior Publication Data

US 2011/0079497 A1 Apr. 7, 2011

(51) Int. Cl.
*H01H 9/00* (2006.01)

(52) U.S. Cl. ..... 200/314; 200/512

(58) Field of Classification Search ..... 200/314
See application file for complete search history.

(56) References Cited

U.S. PATENT DOCUMENTS

| | | | | |
|---|---|---|---|---|
| 6,046,730 | A | 4/2000 | Bowen et al. | |
| 6,593,537 | B2 * | 7/2003 | Teruyama et al. | 200/515 |
| 8,025,435 | B2 * | 9/2011 | Tatehata et al. | 362/616 |
| 2007/0039809 | A1 * | 2/2007 | Aihara et al. | 200/310 |
| 2008/0019117 | A1 | 1/2008 | Ng et al. | |
| 2008/0186736 | A1 | 8/2008 | Rinko | |
| 2009/0067151 | A1 * | 3/2009 | Sahlin et al. | 362/23 |
| 2009/0091912 | A1 * | 4/2009 | Lee | 362/30 |

FOREIGN PATENT DOCUMENTS

WO WO 2008/077987 7/2008

OTHER PUBLICATIONS

Panasonic, Tactile Sheet, Feb. 2008, http://www-images.panasonic.com/industrial/components/pdf/ATE0000CE4.

* cited by examiner

*Primary Examiner* — Renee Luebke
*Assistant Examiner* — Lheiren Mae Caroc

(57) ABSTRACT

A keypad illumination apparatus having a key plate member, a flexible light guide film, a reflective layer, a plurality of metal domes, a light source and a substrate. The key plate member may have a plurality of keys formed thereon. The flexible light guide film is configured to transmit light from the light source and has a plurality of plunging structures and apertures to accommodate the plurality of metal domes, which may be configured to actuate a plurality of electrical switches on the substrate.

21 Claims, 7 Drawing Sheets

KEYPAD ILLUMINATION APPARATUS

BACKGROUND

Keypads are widely used in portable electronic devices such as mobile phones and personal digital assistants (PDA). Keypad is a user interface device, in which a user makes inputs by pressing certain keys on the keypad. The act of pressing the keys acts to turn on or off switches typically located on a substrate such as a printed circuit board. The act of turning electrical switches on or off is known as "actuating" the switches and will be referred to as such hereinafter. Generally, in portable applications, small size is highly desirable. However, ensuring adequate illumination of the keypad may negatively impact size and functionality.

BRIEF DESCRIPTION OF THE DRAWINGS

Illustrative embodiments by way of example, not by way of limitation, are illustrated in the drawings, in which.

DETAILED DESCRIPTION

Figure 1:
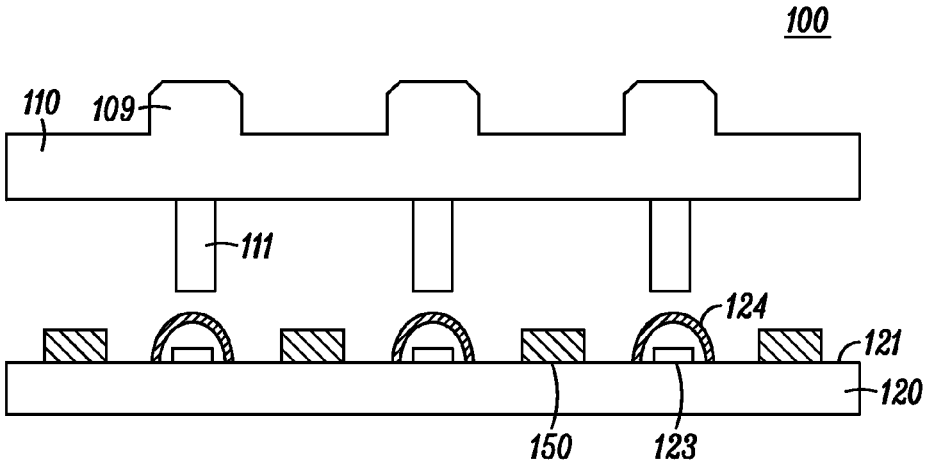
FIG. 1 illustrates a cross-section view of a direct backlighting keypad.

FIG. 1 illustrates a cross-sectional view of a direct backlighting keypad assembly 100. The keypad assembly 100 includes a key plate member 110 with a plurality of key buttons 109 formed thereon. A plurality of protrusions 111, which act as plungers, are formed beneath and correspond to key buttons 109. A substrate 120 is disposed below key plate member 110. The substrate 120 has a plurality of electrical contacts 123 and a plurality of metal domes 124 located at top surface 121. The plurality of metal domes 124 are positioned over and correspond with each of the plurality of electrical contacts 123.

The electrical contacts 123 and the metal domes 124 are positioned beneath corresponding protrusions 111 such that when a force is applied to a key button 109, the force will be transferred by the protrusion 111 beneath key button 109 to compress a corresponding metal dome 124 and subsequently actuating a corresponding electrical contact 123 beneath the metal dome 124. Protrusions 111 are typically referred to as plungers or actuators. LEDs 150 are disposed on the substrate 120 and are operable to illuminate key buttons 109 and key plate member 110. Keypad assembly 100 is considered a direct backlighting type keypad, because keys 109 are illuminated directly from behind by LEDs 150. Due to limitations in the number of LEDs 150 on a substrate 120 and in order to ensure uniformity of illumination, direct backlighting keypads have thickness disadvantages.

Figure 2:
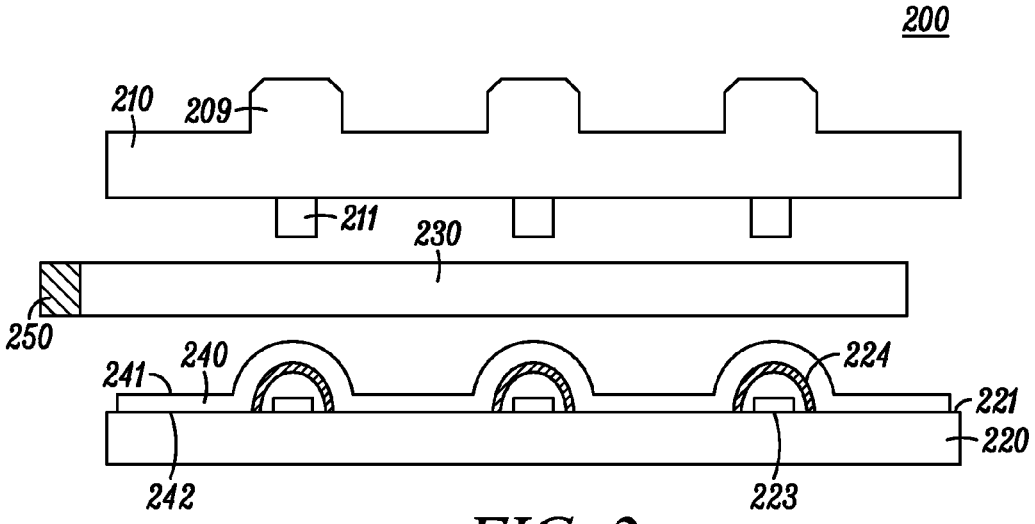
FIG. 2 illustrates a cross-sectional view of a side backlighting keypad.

Side backlighting keypads may have some advantages compared to the direct backlighting keypad, especially in terms of illumination uniformity and thickness. FIG. 2 illustrates a cross-sectional view of a side backlighting keypad assembly 200 according. Keypad assembly 200 includes a key plate member 210, a flexible light guide film 230, a substrate 220, a reflective sheet 240, a plurality of metal domes 224 and at least one side emitting LEDs 250. Key plate member 210 has a plurality of key buttons 209 formed thereon. A plurality of protrusions 211 are disposed beneath the key buttons 209, acting as plungers. Side emitting LEDs 250 are operable to emit light into the flexible light guide film 230, which is disposed beneath the key plate member 210.

Keypad assembly 200 is referred to as a side backlighting type, because the light emitted from the LEDs 250 is not directly illuminating key buttons 209 from behind, but rather is illuminating into the plane of the flexible light guide film 230 from the side first before being transmitted through the flexible light guide film 230 to illuminate keys 209. Reflective sheet 240 may contain a reflective upper surface 241 and an adhesive lower surface 242. Reflective sheet 240 is disposed below the flexible light guide film 230. Reflective sheet 240 holds metal domes 240 onto the substrate 220 by means of the adhesive lower surface 242. Metal domes 224 are positioned over corresponding electrical contacts 223 on the upper surface 221 of substrate 220.

When a key button 209 is depressed, the depressive force is transferred to compress a corresponding metal dome 224 through the flexible light guide film 230, which acts to actuate a corresponding electrical contact 223. The flexible light guide film 230 in the keypad 200 should contain sufficient elasticity to enable an individual key to be actuated by the user. For example, if the light guide film 230 is not sufficiently elastic, a force applied to a specific key 209 may act to compress several metal domes 224, which would result in several electrical contacts 223 being actuated, rather than only one particular electrical contact 223 being actuated as desired. The challenges in side backlighting keypads 200 are reliability of light guide film 230, uniformity of illumination and the thickness of the keypad assembly 200.

Figure 3:
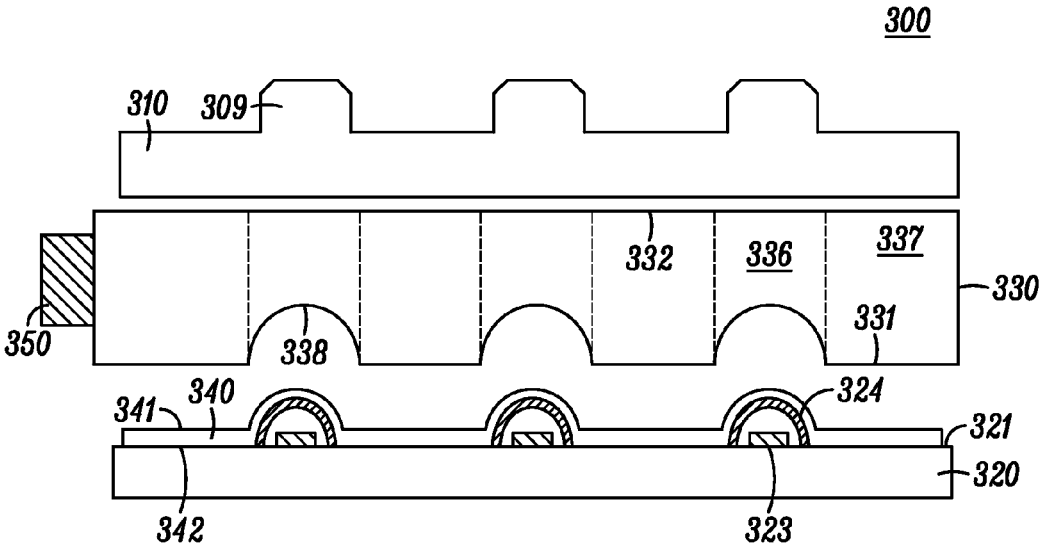
FIG. 3 illustrates an embodiment of a keypad with metal domes.

FIG. 3 illustrates a side-sectional view of an embodiment of a keypad assembly 300. Keypad assembly 300 may include a key plate member 310, a flexible light guide film 330, a reflective layer 340, at least one light source 350 and a substrate 320. The key plate member 310 may comprise an elastic pad with a plurality of key buttons 309 formed thereon. A portion or portions of the key plate member 310 may be transparent, permitting characters printed on the key plate member 310 to be visible when the key plate member 310 is illuminated. Flexible light guide film 330 may be disposed beneath the key plate member 310 and function as light channel. The flexible light guide film 330 may comprise a thin rectangular sheet or may be any shape deemed suitable to illuminate the key plate member 310. Flexible light guide film 330 may be made of any sufficiently transparent, flexible material, such as poly carbonate (referred to hereinafter as PC), poly urethane (referred to hereinafter as PU), poly ethylene (referred to hereinafter as PET) and poly-methyl-methacrylate (referred to hereinafter as PMMA) or a similar material.

The flexible light guide film 330 comprises an upper surface 332 and a lower surface 331. The upper surface 332 may be substantially flat. Light emitted from light source 350 may be illuminated into the flexible light guide film 330 from a side surface as shown in FIG. 3 and may be transmitted through flexible light guide film 330 to illuminate the keys 309 through optical patterns disposed on or below the upper surface 332. Micro-optics can be found at the lower surface 331 to regulate light.

Portions of the flexible light guide film 330 may be hardened or made of a sufficiently hard material to function as plunger. These hardened portions are referred to as plunging structures 336. The plunging structures 336 may be fabricated, for example, by adding a hardening material such as a peroxide cross linking agent to the flexible light guide film 330. Sintering, a method for making objects from powder by heating the material below its melting point (solid state sintering) until its particles adhere to each other can also be used. Another hardening method may include exposing the selected portions to an ultra violet light (refer to as UV hereinafter) at a predetermined temperature for a predetermined time period after the flexible light guide film 330 has been fabricated. Other than the hardened plunging structures 336, other areas of the flexible light guide film 330 may remain elastic and will be referred as elastic portion 337 hereafter.

The plunging structures 336 may be positioned below some or all of key buttons 309 on the key plate member 310. An aperture 338 may be positioned at the bottom of each plunging structure 336. The apertures 338 may accommodate metal domes 324 such that the metal domes 324 may form fit or snap fit into the flexible light guide film 330. A typical shape for the apertures 338 may be a semi-circle or dome shape, but other shapes are anticipated, such as conical.

The reflective layer 340 may have an upper surface 341 and a lower surface 342. Reflective layer 340 may be disposed beneath the flexible light guide film 330. The upper surface 341 may be made reflective to minimize light loss and direct more light toward keypad member 310. The lower surface 342 may be adhesive such that reflective layer 340 is capable of holding the metal domes 324 in place on substrate 320. The metal domes 324 may be aligned and fixed over corresponding electrical switches 323. Adhesive layer 342 of reflective layer 340 is an effective method for holding the small metal domes 324 above the switches 323. The electrical switches 323 may be disposed on the upper surface 321 of the substrate 320. The substrate 320 may comprise a printed circuit board or similar structure. Each respective layer, e.g. keypad member 310, flexible light guide film 330, substrate 320 and reflective layer 340 may be physically held together mechanically in the keypad assembly 300 by means of aligning mechanical features.

The light source 350 may be attached or coupled to the substrate 320 or can be attached or coupled to a different part of the keypad assembly. The light source 350 may be a side emitting LED (light emitting diode) coupled or attached to the substrate 320. A side emitting LED is a space efficient design as only one substrate is required in the keypad assembly. Theoretically one light source should be sufficient, assuming the light guide film 330 is ideally transparent and the overall keypad assembly is sufficiently small. Obviously, for larger keypad designs, 2-4 or more than LEDs may be desired to ensure adequate and uniform lighting across the keypad.

The metal domes 324 may provide two functions. First, the metal domes 324 may act as mechanical barriers or a diaphragm when the metal domes 324 are compressed via the plunging structures 336, providing tactile feedback to a user pressing on the keys 309. Second, the metal domes 324 actuate the electrical switches 323 by means of electrical conductivity when the metal domes 324 are compressed a predetermined amount. The metal domes 324 can be replaced by the apertures 338 if the apertures 338 can be made hard enough.

Figure 4:
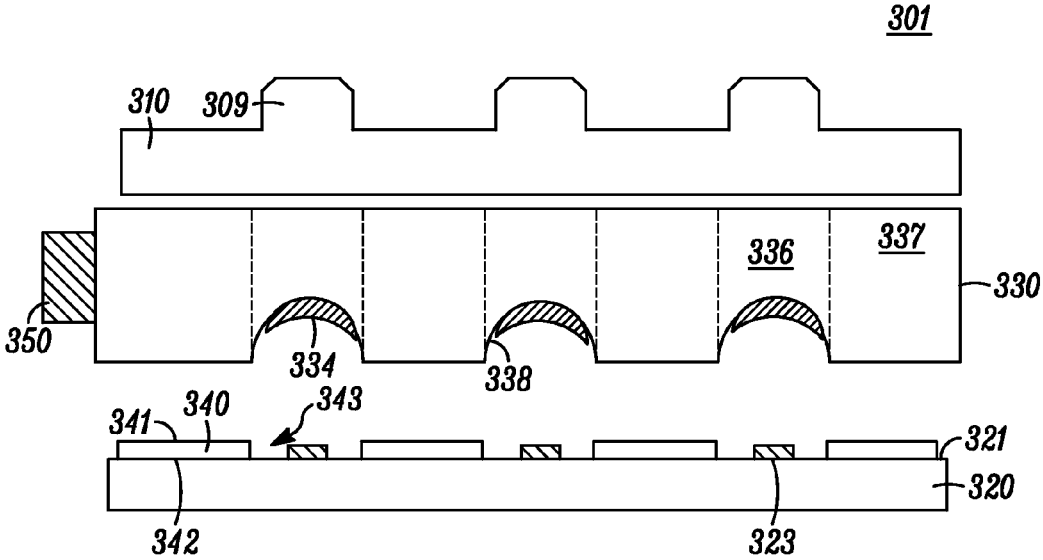
FIG. 4 illustrates an embodiment of a keypad without metal domes.

FIG. 4 shows an alternate embodiment of keypad assembly 301. In FIG. 4, the keypad assembly 301 includes key plate member 310, a light source 350, a flexible light guide film 330, a reflective layer 340 and a substrate 320, similar to the keypad assembly 300 of FIG. 3. The embodiment of FIG. 4 does not utilize metal domes 324 as shown in FIG. 3. However, metal domes 324 of FIG. 3 may be replaced by electrically conductive layer 334 within the apertures 338. The electrically conductive layer 334 may be a thin metal layer embedded in the apertures 338. Conductive layer 334 may be any known electrically conductive material. The electrically conductive layer 334 may be too thin to provide tactile feedback to the user who presses on the keys 309. However, the tactile feedback may be provided by the apertures 338 if the regions above apertures 338 are made sufficiently stiff to provide tactile feedback. The actuating of the switches 323 on the substrate 320 may be accomplished by the conductive layer 334.

In FIG. 4, the reflective layer 340 is reflective on the upper surface 341. As the reflective layer does not need to hold the metal domes 342 of FIG. 3 in place in the embodiment of FIG. 4, it may not be necessary for the bottom layer 342 to be adhesive. The reflective layer 340 may have a plurality of openings 343 corresponding to the apertures 338. The alignment of keypad assembly 301 with embedded electrically conductive layer 334 is much simpler than the embodiment of FIG. 3. The alignment of each layer such as the keypad member 310, the flexible light guide film 330, the substrate 320 and the reflective layer 340 may be held together mechanically in the keypad assembly 301 by means of aligning mechanical features.

Most of the flexible light guide film 330 may be elastic portion 337 except at the plunging structures 336 where the flexible light guide film 330 may be hardened enough to enable the transfer of the mechanical force applied to the light guide film 330 to the electrical switches 323 beneath the plunging structures 336 of the light guide film 330. Electrical switches 323 may be formed on the top surface 321 of the substrate 320 at locations across the substrate 320 that correspond with keys 309, plunging structures 336, and conductive layer 334 within apertures 338.

The key plate member 310 may be formed of metal, silicon, plastic or PU. The flexible light guide film 330 may be PC, PU, PET and PMMA. The reflector layer 340 may be a mylar sheet which is milky white in color. Without protrusions 211 (See FIG. 2) at the key plate member 310, the overall thickness of the keypad assembly may be reduced. For example, the keypad assembly shown in FIG. 3 and FIG. 4 may have overall thickness of less than 0.6 mm, whereas the thickness of the keypad assembly of FIG. 2 is approximately 1.1 mm or more.

Figure 5A:
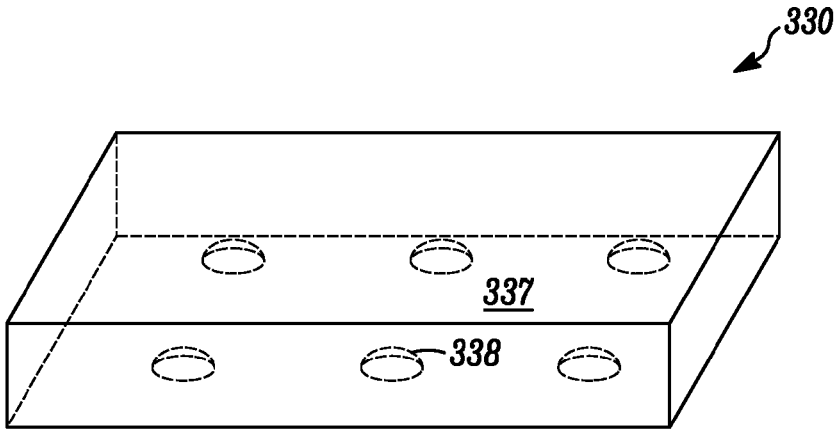
FIG. 5*a* illustrates an embodiment of a light guide film with invisible plunging structures.

The plunging structures 336 may be formed from the same material as the rest of the light guide film 330, but cured with a second additional UV cycle having a different UV curing profile than that used for the rest of the light guide film. Alternatively, the plunging structures 336 may be formed utilizing a sintering method that comprises heating the material below it melting point until the material becomes substantially transparent. An example of a flexible light guide film 330 with trans-parent plunging structures 336 is shown in FIG. 5A. In FIG. 5A, the apertures 338 are visible on the under side of the light guide film. However, the plunging structures 336 are relatively transparent or invisible to the naked eye. The material of plunging structures 336 and elastic areas 337 may be similar, with substantially the same refractive index. Light may enter through elastic portion 337 into the plunging structures 336 without noticeable diffraction or distortion. Examples of materials that display such a profile are PU and PC.

Figure 5B:
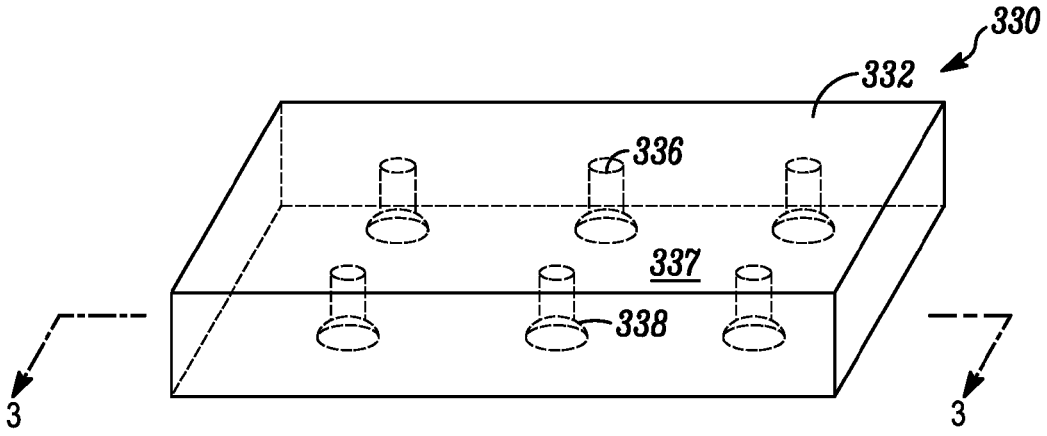
FIG. 5*b* illustrates an embodiment of a light guide film with visible plunging structures.
Figure 6:
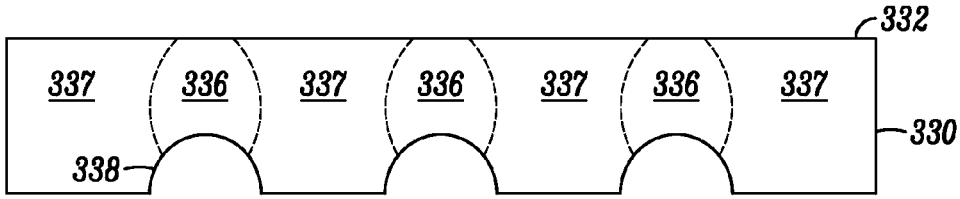
FIG. 6 illustrates a cross sectional view of a light guide film along section line 3-3 of FIG. 5*b;*

However, if the plunging structures 336 are made of a material with different optical properties than the elastic areas 337, for example by adding a hardening material such as a peroxide cross-linking agent to the flexible light guide film 330, the plunging structures 336 may be visible or noticeable to the naked eye. The elastic area 337 may form the largest portion of flexible light guide film 330. Another embodiment of a flexible light guide film 330 is shown in FIG. 5B. In this embodiment, plunging structures 336 may resemble a cylindrical shape as shown in FIG. 5B. However, the plunging structures 336 can be of any shape capable of performing the function of transferring the physical force applied at the upper surface 332. FIG. 6 illustrates a cross-sectional view of the flexible light guide film 330 taken along section line 3-3 shown in FIG. 5B.

Although plunging structures 336 appear as substantially cylindrical shapes in the drawings, in reality, the shape of plunging structures 336 may be more complex due to the optical properties of light, which can be refracted and reflected. For example, as shown in the embodiment of FIG. 6, the plunging structures 336 may be slightly slanted or tilted. One explanation for the variability of the shape of the plunging structures 336 is susceptibility of the manufacturing process to the variation of optical and heat dissipation properties, as well as the variation in the mechanical tolerances of manufacturing equipment. Nevertheless, the precise shape of the plunging structures 336 should not affect the functionality of transferring physical force applied to an upper surface to actuate electrical switches 323 of FIG. 4. Although some shapes may be preferable for manufacturing or actuating purposes, virtually any shape will suffice, as long as the plunging structures 336 are capable of transferring a force applied at upper surface 332 onto the aperture 338.

Figure 7:
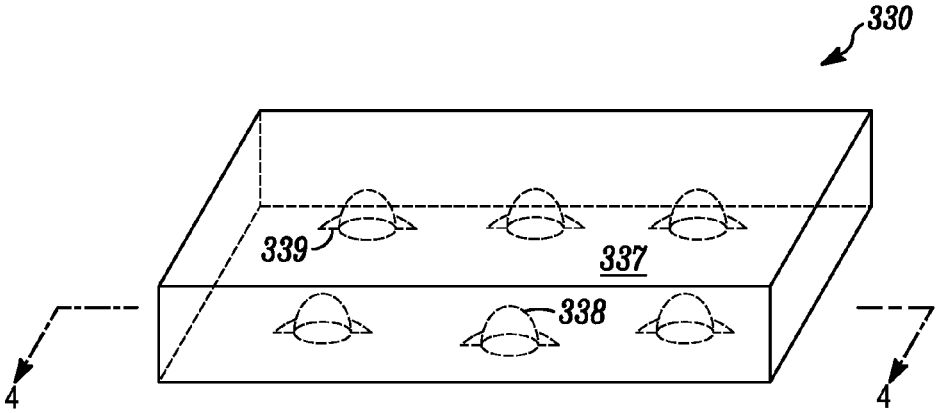
FIG. 7 illustrates an embodiment of a light guide film with cut slits.
Figure 8:
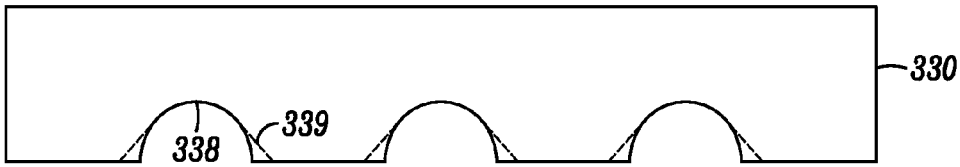
FIG. 8 illustrates a cross sectional view of a light guide film along section line 4-4 of FIG. 7

The apertures 338 may snap or form fit onto the metal domes 324. However, air may become trapped during the process and providing an air escape channel may be desirable. FIG. 7 illustrates an embodiment of the flexible light guide film 330 having apertures 338 with such air escape channel features. In FIG. 7, plunging structures 336 exist but are not explicitly shown. A thin slit or small channel 339 may be formed near each aperture 338. While FIG. 7 illustrates a small channel 339 on opposing sides of apertures 338, there may be one or more such air escape channels on one or more sides of apertures 338. FIG. 8 shows cross-sectional view of the flexible light guide 330 along section line 4-4 in FIG. 7. When the metal domes 324 as shown in FIG. 3 are fitted into the apertures 338, the small channel 339 will function as an air escape channel. The number of cut slits or small channels 339 should be at least one, but can be as many as possible to provide the function of dissipating any trapped air between apertures 338 and metal domes 324.

Referring to FIG. 3, light emitted from LED 350 may travel from the first lateral end where the LED 350 is located to the other lateral end due to total internal reflection phenomenon. In order to channel and direct light to illuminate the keys 309, optical patterns may be formed at the upper surface 332. The angle and direction of light reflected due to total internal reflection may also be controlled by using microoptical structures, usually located at lower surface 331. Using optical patterns and micro-optical structures, not only the illumination area, but also the amount and intensity of light illuminated on the key plate member 310 may be designed with some precision.

Figure 9:
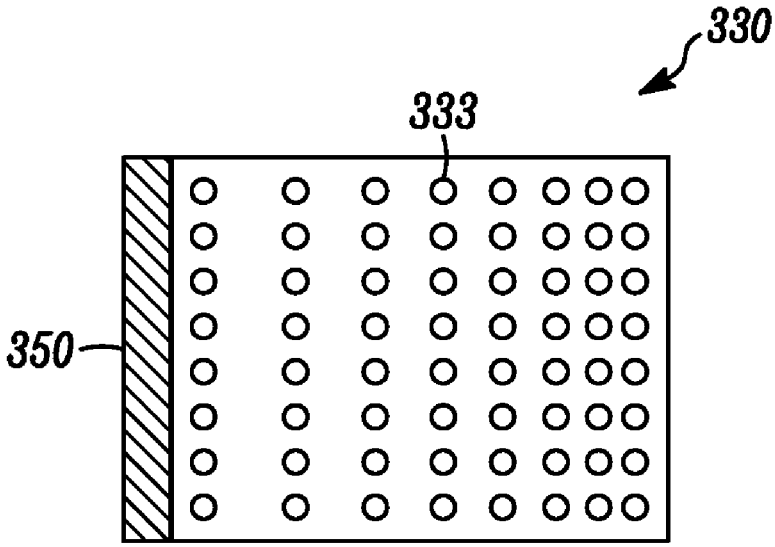
FIG. 9 illustrates an embodiment with optical patterns at an upper surface of a flexible light guide film.

FIG. 9 shows an embodiment illustrating the optical patterns 333 found on the upper surface 332 of the flexible light guide film 330 of FIG. 3. Having optical patterns 333 would enable light to be illuminated onto the surface instead of traveling laterally. In the embodiment shown in FIG. 9, the light source 350 is located at one lateral end, and the number of the optical patterns 333 increases moving away from the light source. Although the light emitted form the light source 350 would get dimmer moving away from the light source 350, due to the increased numbers of optical patterns 333 per unit area moving away from the light source 350, illumination at the surface of the flexible light guide film 330 may remain relatively uniform across the surface. The optical patterns 333 may also be implemented using a diffusion sheet on the flexible light guide film 330 of FIG. 3. The diffusion sheet may be disposed on top of the flexible light guide film 330 of FIG. 3 but below the key plate member 310 of FIG. 3.

Figure 10:
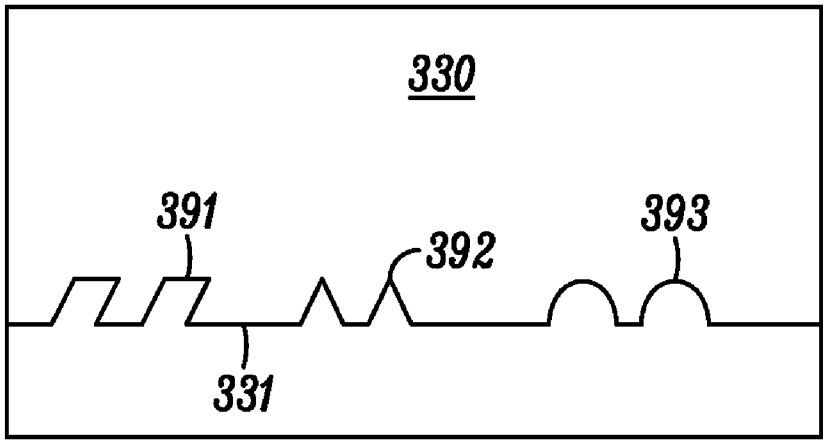
FIG. 10 illustrates an embodiment with micro-optic structures on a lower surface of a light guide film.
Figure 11:
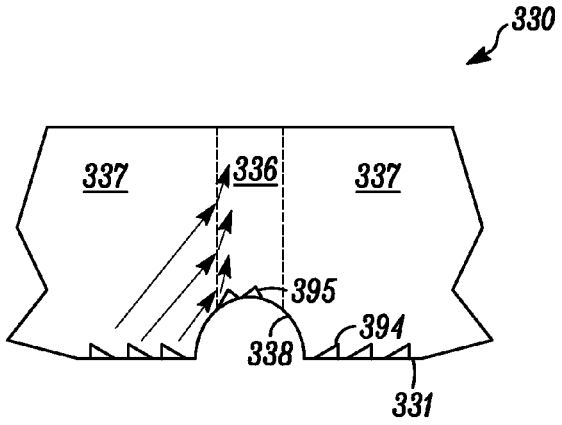
FIG. 11 illustrates an embodiment of micro-optic structures located at apertures in a flexible light guide film.

FIG. 10 illustrates a cross-sectional view of several different potential embodiments of micro-optic structures 391-393. Micro-optic structures 391-393 may be formed on the lower surface 331 of flexible light guide film 330. The shapes shown in FIG. 10 (slanted, sinusoidal, triangular etc) represent only a few examples of the cross sectional shapes that the micro-optic structures 391-393 may have. FIG. 11 illustrates one embodiment of micro-optic structures 395 located at the apertures 338 and lower surface 331 of flexible light guide film 330. As discussed earlier, light entering plunging structures 336 from elastic portion 337 may be diffracted, giving negative impact on uniformity if the material at the elastic portion 337 and the plunging structures 336 have different refractive index. One possible method to compensate for this negative effect is to form micro-optic structure 395 on the apertures 338 as well as micro-optic structures 394 on the lower surface 332 to channel and direct the light such that the non-uniformity can be compensated. The shape and location of micro-optics structures may be determined using optical simulation tools. Typically, micro-optics structures 394-395 may be micro-meters in size and may be fabricated with conventional light guide processes such as hot press and roll-toroll replication.

Figure 12:
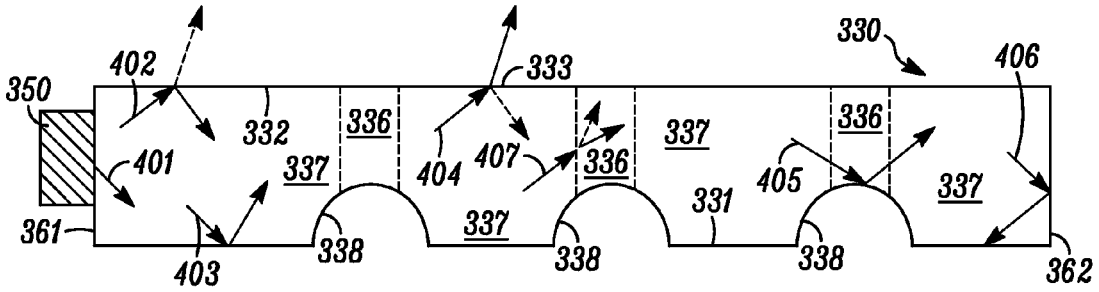
FIG. 12 shows an embodiment illustrating light being transmitted within a flexible light guide film.

FIG. 12 is a cross-sectional view of flexible light guide film 330, illustrating light being transmitted through the flexible light guide film 330. The light source 350 may transmit light into the flexible light guide film 330, from one lateral end 361 to another lateral end 362 before being reflected back and forth. For example ray 401 can be emitted from the light source 350 into the flexible light guide film 330. At the upper surface 332, ray 402 may be reflected back into the flexible light guide film 330 due to total internal reflection. Ray 403 may be reflected due to total internal reflection or due to the reflective layer 340 (See FIG. 3). At the upper surface 332 where the optical pattern 333 is located, ray 404 may be illuminating onto the surface instead of being reflected back. At the aperture 338, ray 405 is reflected back to the flexible light guide film 330. On the lateral end 362, ray 406 is reflected back towards lateral end 361 due to total internal reflection. When entering the plunging structures 336 from the elastic portion 337, ray 407 may maintain the light traveling direction. Alternatively, ray 407 may be diffracted if the refractive index of the plunging structures 336 is different from the elastic portion 337. Light loss may occur during total internal reflection. However, the loss is usually small, for example less than 5%.

Figure 13:
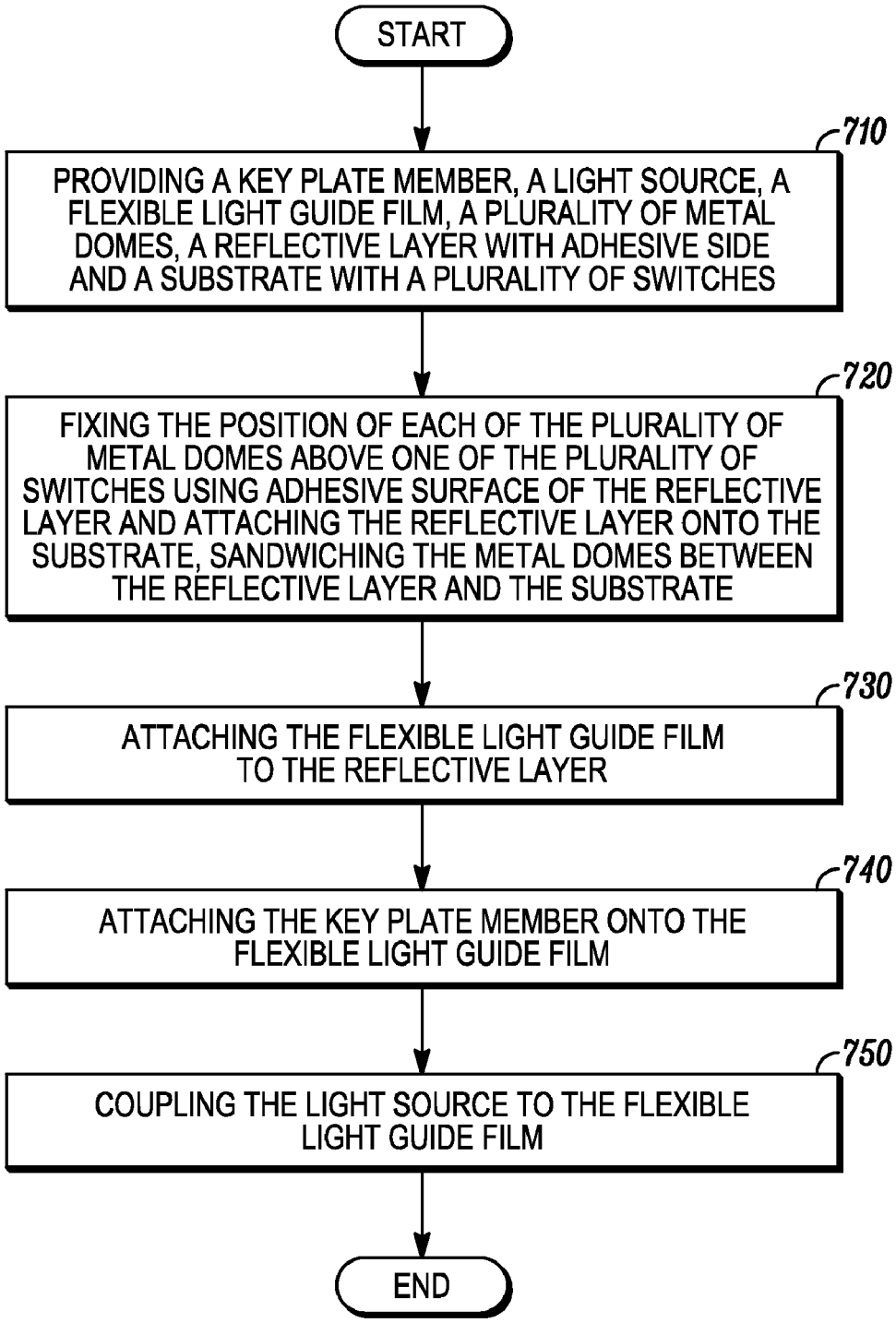
FIG. 13 shows a flow chart illustrating a method for assembling a keypad apparatus.

FIG. 13 shows a flow chart depicting a method of manufacturing a keypad assembly of a mobile input device which may be used in conjunction with the flexible light guide film 330 of keypad assembly 300 (See FIG. 3). In step 710, a key plate member having a plurality of keys, a light source, a flexible light guide film, a plurality of metal domes, a reflective layer with an adhesive surface and a substrate with a plurality of switches are provided. The flexible light guide film further comprises a plurality of plunging structures and a plurality of apertures formed within the light guide film. The plurality of plunging structures are positioned above and corresponding to each of the plurality of apertures. In Step 720, metal domes are positioned above the electrical switches of the substrate by attaching the adhesive side of the reflective layer onto the substrate with the metal domes sandwiched between the reflective layer and the substrate. In step 730, the flexible light guide film is assembled onto the reflective layer, which may be accomplished by matching the apertures of the flexible light guide film to the domes of the switches such that each of the plurality of apertures and corresponding plunging structures corresponds with one of the plurality of metal domes and one of the corresponding electrical switches. In step 740, the key plate member is assembled onto the flexible light guide film such that each of the plurality of keys on the key plate member corresponds with one of the plurality of plunging structures in the flexible light guide film. In step 750, the light source is coupled to the flexible light guide film in order to illuminate the keypad. This can be done either by attaching the light source to the substrate or by attaching the light source to a different substrate but positioned such that light emitted from the light source can be illuminated to the light guide film.

The apertures may be shaped to accommodate the metal domes such that the metal domes are capable of snap or form fitting into the apertures. FIG. 3 and FIG. 7 show similar concepts with the apertures in the light guide film having dome shapes such that metal domes may be snap or form fitted into these apertures. The light guide film may also have at least one slit or one channel to provide an air escape channel when the metal domes is fitted into the apertures.

Although specific embodiments of the invention have been described and illustrated herein above, the invention is not to be limited to the specific forms or arrangements of parts so described and illustrated. For example, light source described above can be LEDs as disclosed in the embodiments herein, but can also be a laser, a sheet of illuminating material or some other future light source. The scope of the invention is to be defined by the claims appended hereto and their equivalents.

What is claimed is:

1. A keypad comprising:

a key plate member, wherein the key plate member has a plurality of keys formed thereon;

a flexible light guide film disposed below the key plate member and configured to transmit light to the plurality of keys formed on the key plate member;

at least one light source configured to emit light into the flexible light guide film;

a plurality of plunging structures defined by portions of the flexible light guide film that are hardened to function as plungers, wherein the plurality of plunging structures are positioned beneath and correspond to all or some of the plurality of keys;

a plurality of apertures formed within the flexible light guide film and positioned beneath and corresponding to all or some of the plunging structures;

a reflective layer disposed below the flexible light guide film;

a substrate disposed below the reflective layer; and a plurality of electrical switches on an upper surface of the substrate, wherein the plurality of electrical switches are positioned beneath and corresponding to all or some of the apertures.

2. The keypad of claim 1, further comprising metal domes, wherein the metal domes are positioned over the electrical switches and the apertures have a shape to accommodate the metal domes such that the metal domes are configured to fit into the apertures.

3. The keypad of claim 1, wherein the apertures act as mechanical barrier when the apertures are compressed through the plunging structures upon keypad actuation so as to provide tactile feedback to a user of the keypad.

4. The keypad of claim 1, wherein each aperture has an electrically conductive layer formed inside and within the aperture configured to actuate the electrical switches on the substrate when the aperture is compressed.

5. The keypad of claim 1, wherein the flexible light guide film has a top surface and a bottom surface, wherein the bottom surface has micro-optic structures configured to direct light emitted from the light source, and wherein the top surface has optical patterns capable of causing the light to be emitted from the top surface towards the key plate member.

6. The keypad of claim 1, wherein the keypad further comprises a diffusion sheet with optical patterns, and wherein the diffusion sheet is disposed on top of the flexible light guide film but below the key plate member.

7. The keypad of claim 1, wherein the apertures further comprise micro-optic structures formed thereon.

8. The keypad of claim 1, wherein the plunging structures have a similar refractive index as the flexible light guide film.

9. The keypad of claim 1, wherein the reflective layer has a reflective top surface and an adhesive bottom surface.

10. The keypad of claim 1, wherein the keypad forms a portion of a mobile input device.

11. The keypad of claim 1, wherein the plunging structures are embedded within the flexible light guide film.

12. The keypad of claim 1, wherein the flexible light guide film defines a substantially thin flat film having a substantially flat surface on one side.

13. The keypad of claim 12, wherein each of the plurality of the plunging structures is in direct contact with the flat surface on one end, and one of the apertures on the other end.

14. The keypad of claim 1, wherein the plunging structures are transparent and differ from the flexible light guide film in that the plunging structures are hardened compared to the flexible light guide film.

15. A keypad assembly of a mobile input device comprising:

a printed circuit board having a plurality of electrical switches formed thereon;

a reflective layer disposed on the printed circuit board;

a flexible light guide film disposed on the reflective layer;

wherein the flexible light guide film further comprises a plurality of apertures on a bottom surface of the flexible light guide film and positioned corresponding to the electrical switches;

wherein portions of the flexible light guide film are hardened to define a plurality of plunging structures, and wherein the plunging structures are positioned above and corresponding to the apertures;

a keypad member disposed on the flexible light guide film; and a light source coupled to the flexible light guide film, wherein the light source is a side-emitting LED.

16. The keypad assembly of claim 15 further comprising a plurality of metal domes configured above the plurality of electrical switches on the printed circuit board, wherein the apertures are shaped to accommodate the metal domes such that the metal domes are configured to form fit into the apertures, and wherein the apertures and corresponding plunging structures are configured to provide tactile feedback to a user of the keypad upon keypad actuation.

17. The keypad assembly of claim 15, further comprising an electrically conductive material between each of the plurality of apertures and each of the plurality of electrical switches, wherein the electrically conductive material is configured to actuate the electrical switches on the printed circuit board.

18. The keypad assembly of claim 17, wherein the electrically conductive material is formed inside and within each aperture.

19. The keypad assembly of claim 15, wherein the plunging structures are embedded inside the flexible light guide film.

20. The keypad assembly of claim 15 wherein each plunging structure is in contact with a flat surface on one end and the aperture on the other end.

21. A method of manufacturing an input device, comprising:

providing a key plate member with a plurality of keys formed thereon, a flexible light guide film, a side emitting light source, a plurality of metal domes, a reflective layer with an adhesive surface and a substrate with a plurality of switches, wherein the flexible light guide film further comprises a plurality of apertures on a bottom surface and a plurality of plunging structures defined by hardened portions of the flexible light guide film and corresponding to each of the plurality of apertures;

fixing the position of each of the plurality of metal domes above one of the plurality of switches using the adhesive surface of the reflective layer and attaching the reflective layer onto the substrate, sandwiching the metal domes between the reflective layer and the substrate;

attaching the flexible light guide film to the reflective layer, wherein each of the plurality of apertures and corresponding plunging structures corresponds with one of the plurality of metal domes and corresponding electrical switches;

attaching the key plate member onto the flexible light guide film, wherein each of the plurality of keys on the key plate member corresponds with one of the plurality of plunging structures in the flexible light guide film; and coupling the side emitting light source to the flexible light guide film.

* * * * *